US006126889A

United States Patent [19]

Scott et al.

[11] Patent Number: 6,126,889

[45] Date of Patent: Oct. 3, 2000

[54] PROCESS OF PREPARING MONOLITHIC SEAL FOR SAPPHIRE CMH LAMP

[75] Inventors: Curtis E. Scott, Mentor; Mary Sue Kaliszewski, Lyndhurst, both of Ohio

[73] Assignee: General Electric Company, Cleveland, Ohio

[21] Appl. No.: 09/022,323

[22] Filed: Feb. 11, 1998

[51] Int. Cl.[7] ..... B28B 1/00

[52] U.S. Cl. ..... 264/632; 264/642; 264/656; 264/657; 264/662; 313/624

[58] Field of Search ..... 264/632, 642, 264/656, 657, 662

[56] References Cited

U.S. PATENT DOCUMENTS

| | | | |
|---|---|---|---|
| 3,385,463 | 5/1968 | Lange . | |
| 3,564,328 | 2/1971 | Bagley et al. . | |
| 4,354,717 | 10/1982 | Rech et al. | 316/19 |
| 4,545,799 | 10/1985 | Rhodes et al. . | |
| 4,563,214 | 1/1986 | Seddon et al. . | |
| 4,694,219 | 9/1987 | Hing . | |
| 4,707,636 | 11/1987 | Morris . | |
| 4,765,820 | 8/1988 | Naganawa et al. . | |
| 4,808,882 | 2/1989 | Parker et al. | 313/625 |
| 5,099,174 | 3/1992 | Coxon et al. . | |
| 5,426,343 | 6/1995 | Rhodes et al. . | |
| 5,427,051 | 6/1995 | Maxwell et al. . | |
| 5,451,553 | 9/1995 | Scott et al. . | |
| 5,727,975 | 3/1998 | Wei et al. | 445/22 |
| 5,742,124 | 4/1998 | Kees et al. | 313/625 |

FOREIGN PATENT DOCUMENTS

| | | | |
|---|---|---|---|
| 0 142 202 | 5/1985 | European Pat. Off. | H01J 61/36 |
| 0 220 813 | 5/1987 | European Pat. Off. | H01J 61/36 |
| 0 667 404 | 8/1995 | European Pat. Off. | C30B 29/20 |
| 0 757 375 | 2/1997 | European Pat. Off. | H01J 61/36 |
| 54-47380 | 4/1979 | Japan . | |

OTHER PUBLICATIONS

Abstract of JP 54047380 A.

*Primary Examiner*—James Derrington
*Attorney, Agent, or Firm*—Pearne & Gordon LLP

[57] ABSTRACT

A method of producing a ceramic-metal-halide (CMH) discharge lamp having a monolithic seal between a sapphire (single crystal alumina) arc tube and a polycrystalline alumina end cap. The method includes the steps of providing an arc tube of fully dense sapphire and providing an end cap made of unsintered compressed polycrystalline alumina powder. The end cap is heated until it is presintered to remove organic binder material at a low temperature relative to the sintering temperature. The presintered end cap is placed on an end portion of the arc tube to form an interface therebetween. The assembled presintered end cap and arc tube are then heated to the sintering temperature wherein the end cap is fully sintered onto the arc tube and the sapphire tube grows into the end cap. A monolithic seal is formed at the previous interface between the end cap and the arc tube as the sapphire tube grows into the polycrystalline alumina end cap.

17 Claims, 2 Drawing Sheets

PROCESS OF PREPARING MONOLITHIC SEAL FOR SAPPHIRE CMH LAMP

BACKGROUND OF THE INVENTION

The present invention generally relates to sealing arc tubes for high-pressure discharge lamps and, more particularly, to sealing arc tubes composed of sapphire for high-pressure discharge lamps.

High-pressure discharge lamps, such as ceramic-metal-halide (CMH) lamps, commonly utilize ceramic arc tubes which are transparent or translucent. The ceramic tube should have high-corrosion resistance, high-temperature capabilities, and high light transmissivity. The opposite ends of the ceramic arc tube are closed and sealed by ceramic end assemblies such as plugs or caps. The end assemblies also support discharge electrodes made of molybdenum or tungsten. The electrodes extend through the end assemblies and are hermetically sealed therein. An arc discharge is formed within the tube between the electrodes when current is applied to the electrodes.

The metal halide arc tubes can be composed of polycrystalline alumina which has superior chemical attack resistance and higher practical operating temperatures than customary quartz metal halide arc tube materials. Polycrystalline alumina is a preferred arc tube material in current commercial practice. The polycrystalline alumina arc tubes are typically sealed with polycrystalline end plugs.

It has been proposed to use sapphire (single crystal alumina) instead of polycrystalline alumina as the arc tube material in order to gain an additional increase in lamp performance. The increased performance is primarily due to sapphire's increased level of transmission, compared to polycrystalline alumina.

An issue with fabricating sapphire (single crystal alumina) arc tubes, however, is sealing the ends of the arc tube. Conventional methods of sealing quartz and polycrystalline arc tubes have not proven to be satisfactory. Different crystal orientations of sapphire have different thermal coefficients of expansion. The crystal orientation of the sapphire arc tube, therefore, must be precisely oriented so that its thermal expansion coefficient closely matches the thermal expansion coefficient of the plugs or caps in the direction of greatest expansion and/or contraction. When the crystal orientation of the sapphire tube is not precisely oriented in this manner, rapid changes in temperature can crack the sapphire arc tube. Accordingly, there is a need in the art for an improved method of joining end assemblies to sapphire arc tubes.

SUMMARY OF THE INVENTION

The present invention provides a method of making a tube assembly for a ceramic-metal-halide discharge lamp. The method includes the steps of providing a tube made of sapphire or single crystal alumina and providing an end cap made of unsintered polycrystalline alumina. The end cap is heated until it is presintered to remove binder material. The presintered end cap is then placed on an end portion of the tube to form an interface therebetween. The presintered end cap and the tube are heated until the end cap is sintered onto the tube and the sapphire crystal of the tube grows into the end cap to form a monolithic seal at the previous interface between the end cap and the tube.

BRIEF DESCRIPTION OF THE DRAWINGS

These and other features and advantages of the present invention will be apparent with reference to the following description taken in conjunction with the accompanying drawings, wherein.

DETAILED DESCRIPTION OF PREFERRED EMBODIMENTS

Figure 1:
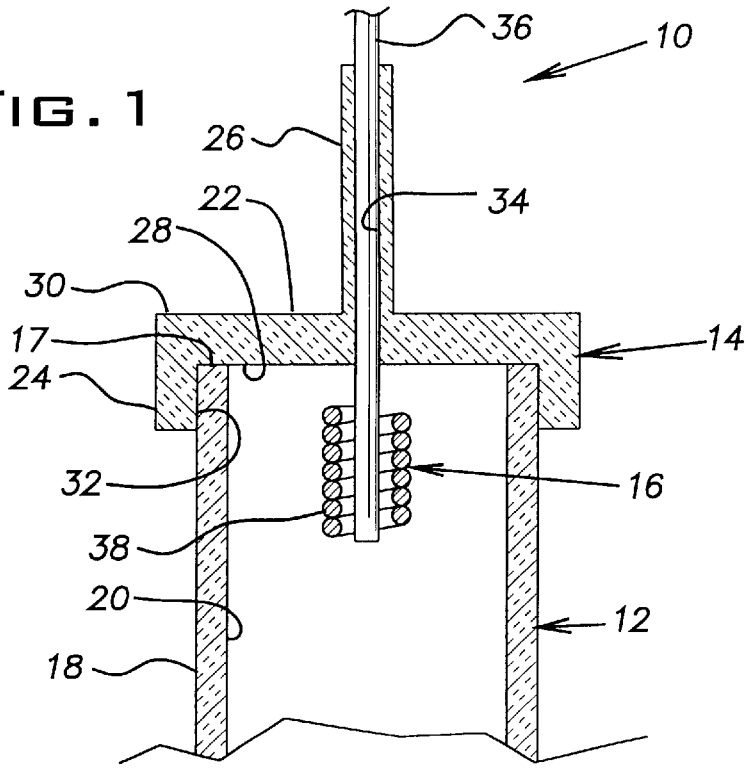
FIG. 1 is a side elevational view, in cross-section, of one end of a lamp assembly having a sapphire arc tube and a ceramic end cap prior to firing according to the present invention.

FIG. 1 illustrates an end of a ceramic metal halide (CMH) lamp assembly 10 according to the present invention. It is noted that both ends of the lamp assembly 10 are identical or substantially similar, therefore, only one end of the lamp assembly 10 is shown and described herein in detail. The lamp assembly 10 includes a high-pressure envelope or arc tube 12 which is transparent, end bushings or caps 14 sealing the open ends of the arc tube 12, and electrode assemblies 16 extending through and supported by the end caps 14 to form an arc within the sealed arc tube 12 when electrical current is applied to the electrode assemblies 16.

The transparent arc tube 12 is formed from sapphire (single crystal alumina) which is fully dense. The arc tube can be produced in any suitable manner. See, for example, U.S. Pat. Nos. 5,427,051, 5,451,553, 5,487,353, 5,588,992, and 5,683,949, for suitable methods of producing sapphire arc tubes, the disclosures of which are expressly incorporated herein in their entirety by reference.

The arc tube 12 is tubularly-shaped having annularly-shaped end surfaces 17 and cylindrically-shaped outer and inner surfaces 18, 20. The wall thickness can be of any suitable size.

The end caps 14 are formed from a suitable polycrystalline ceramic material, preferably polycrystalline alumina, which is in an unsintered or "green state". The end caps 14 most preferably include about 0.02 to about 0.2 percent by weight MgO with polycrystalline alumina powder.

The end caps 14 are preferably formed by cold die pressing a mixture of fine ceramic powder into the desired shape which is described in detail hereinafter. The end caps 14, however, can alternatively be formed by compressing ceramic powder into a body or block and machining the desired shape from the block, by injection molding, or by any other suitable process.

Each end cap 14 has a disc-shaped main wall 22, a cylindrically-shaped skirt or flange 24, and a tubularly-shaped extension 26. The main wall 22 has a planar inner surface 28 facing the end surface of the arc tube 12 and a planar outer surface 30 facing away from the end surface of the arc tube 12.

The flange 24 axially extends inward toward the arc tube 12 from the outer periphery of the main wall 22. The main wall 22 and flange 24 cooperate to form a cup or socket for receiving the end portion of the arc tube 12 therein. The flange 24 has a cylindrically-shaped inner surface 32 which has a diameter sized to form a sufficient monolithic seal with the outer surface 18 of the arc tube 12 as discussed in more detail hereinbelow. The length of the flange inner surface 32 is sized to provide a sufficient sealing area between the end cap 14 and the arc tube 12 as discussed in more detail hereinbelow.

The extension 26 axially extends outward from the outer surface 30 of the main wall 22 and is located generally at the center of the main wall 22. The extension 26 and the main wall 22 cooperate to form an axially extending aperture or hole 34 which passes entirely through the end cap 14. The aperture 34 is sized and shaped to form a sufficient hermetic seal between the electrode assembly 16 and the end cap 14 as discussed in more detail hereinafter. Preferably, the aperture 34 is cylindrically-shaped. The length of the extension 26 is sized to provide sufficient support for the electrode assembly 16 and to provide a sufficient sealing area between the end cap 14 and the electrode assembly 16.

The electrode assembly 16 is of standard construction having a generally straight support 36 and a coil 38 secured to the inner end of the support 36. The support 36 and the coil 38 are each formed from a high temperature and electrically conductive metal such as molybdenum or tungsten.

The "green" end caps 14 are initially heated to a prefiring or presintering temperature to remove organic or binder material and to develop green strength. The prefiring temperature is relatively low compared to the sintering temperature. Preferably, the prefiring temperature is in the range of about 900° C. to about 1100° C. The prefiring is preferably performed in air but alternatively can be any other suitable oxidizing atmosphere for burning-off the organic material.

Once cooled, the presintered end caps 14 are placed over the ends of the arc tube 12 with the end surfaces 17 of the arc tube 12 engaging the inner surfaces 28 of the end cap main walls 22 and the outer surface 18 of the arc tube 12 engaging the inner surfaces 32 of the end cap flanges 24. The end caps 14, therefore, close the open ends of the arc tube 12.

Figure 2:
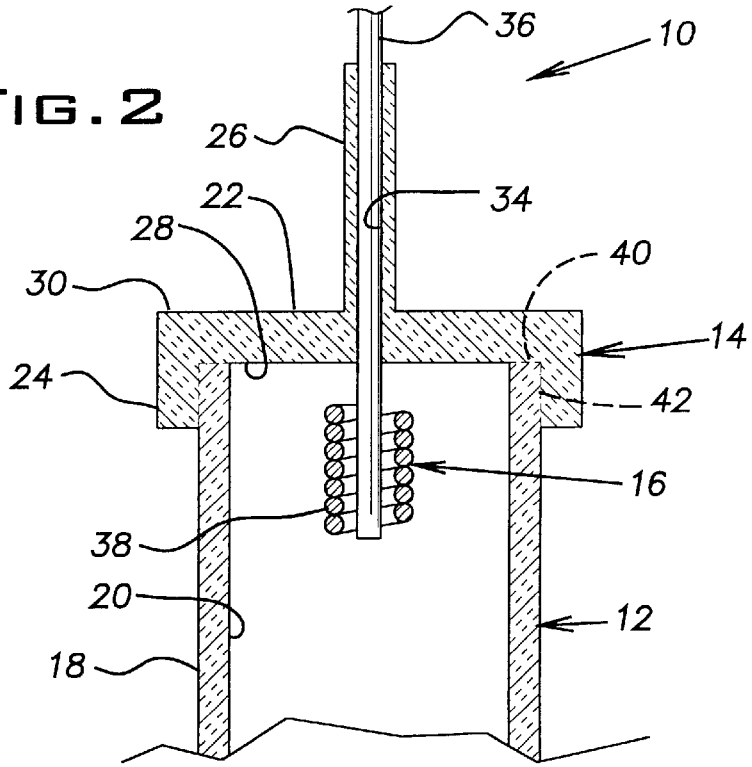
FIG. 2 is a side elevational view, in cross-section, similar to FIG. 1 but after firing to form a monolithic seal between the arc tube and the end cap.

As best shown in FIG. 2, the arc tube 12 and the end caps 14 are heated to a sintering and/or crystal growing temperature which creates a monolithic seal between the arc tube 12 and the end caps 14. Preferably, the sintering temperature is in the range of about 1800° C. to about 1900° C. The sintering is preferably performed in hydrogen but alternatively can be in vacuum, helium, or any other suitable reducing atmosphere. The monolithic seal is created at both the previous interfaces, the first interface 40 between the arc tube end surfaces 17 and the end cap inner surfaces 28 and the second interface 42 between the arc tube outer surface 18 of end cap inner surfaces 32.

Because, the end caps 14 are "green", they shrink as they are heated to the sintering temperature. The sapphire arc tube 12 is fully dense so it does not shrink in size as it is heated to the sintering temperature. The arc tube 12 and the end caps 14 are preferably sized so that the shrinkage of the end caps 14 produces an inner diameter of the end caps 14 which is about 3% to about 7% smaller than the outer diameter of the arc tube 12 after sintering. The shrinkage of the end caps 14 creates stress which drives formation of the monolithic seal, as it facilitates an exaggerated grain growth process. The sapphire (single crystal alumina) of the arc tube 12 grows into the polycrystalline end caps 14 to form the monolithic seal. Continued heat treatment at the sintering temperature anneals out any stresses initially created at the interfaces due to the shrinkage of the end caps 14.

In FIG. 2, the broken lines indicate the previous interfaces 40, 42 between the arc tube 12 and the end caps 14. It is to be understood, however, that there is no longer a discontinuity between the components 12, 14 and the monolithic seal is completely continuous across the previous interfaces. It should also be understood that there is a visible boundary, which is not precisely at the previous interfaces, between the polycrystalline region having grain boundaries and the sapphire region which does not have grain boundaries. Such a boundary is shown in FIG. 2 of U.S. Pat. No. 5,451,553, the disclosure of which is expressly incorporated herein in its entirety by reference.

The end caps 14 can be doped with boundary mobility enhancing materials such as, for example, Gallium or Chromium. The dopants enhance pore removal at the interface and the growth of the sapphire (single crystal alumina) into the polycrystalline alumina. Alternatively, the interface region of the components 12, 14 can be painted with the boundary enhancing materials.

The electrode assemblies 16 are coated with a conventional sealant and frit and are inserted into the apertures. The assembly 10 is then refired to fuse the sealant and provide a hermetic seal between the ceramic end caps 14 and the metal electrode assemblies 16 in a known manner.

Figure 3:
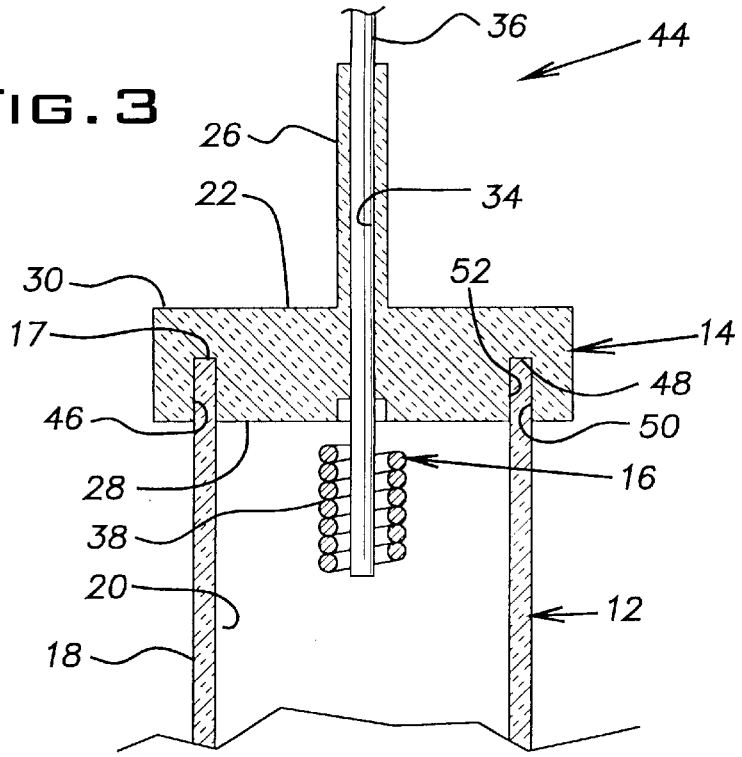
FIG. 3 is a side elevational view, in cross-section, of one end of a lamp assembly having a sapphire arc tube and a ceramic end cap prior to firing according to a second embodiment of the present invention.

FIG. 3 illustrates an end of a ceramic metal halide (CMH) lamp assembly 44 according to a second embodiment of the present invention wherein like references numbers are used for like structure. The lamp assembly 44 is similar to the lamp assembly 10 described with reference to FIG. 1 except that the end caps 14 have an annularly shaped groove 46 rather than the flange 24 (FIG. 1).

The groove 46 axially extends outward into the main wall 22 from the inner surface 28 of the main wall 22. The groove 46 forms a seat or socket for receiving the end portion of the arc tube 12 therein. The groove 46 is formed by an annularly-shaped bottom surface 48, a cylindrically-shaped outer surface 50, and a cylindrically-shaped inner surface 52. The outer surface 50 has a diameter sized to form a sufficient monolithic seal with the outer surface 18 of the arc tube 12 and the inner surface 52 has a diameter sized to form a sufficient monolithic seal with the inner surface 20 of the arc tube 12. The axial length or depth of the groove 46 is sized to provide a sufficient sealing area between the end cap 14 and the arc tube 12.

Once the end caps 14 are presintered as discussed hereinabove with reference to the first embodiment, the end caps 14 are placed over the ends of the arc tube 12 with the end surfaces 17 of the arc tube 12 engaging the bottom surfaces 48 of the end cap grooves 46, the outer surface 18 of the arc tube 12 engaging the outer surfaces 50 of the end cap grooves 46, and the inner surface 20 of the arc tube 12 engaging the inner surfaces 52 of the end cap grooves 46.

Figure 4:
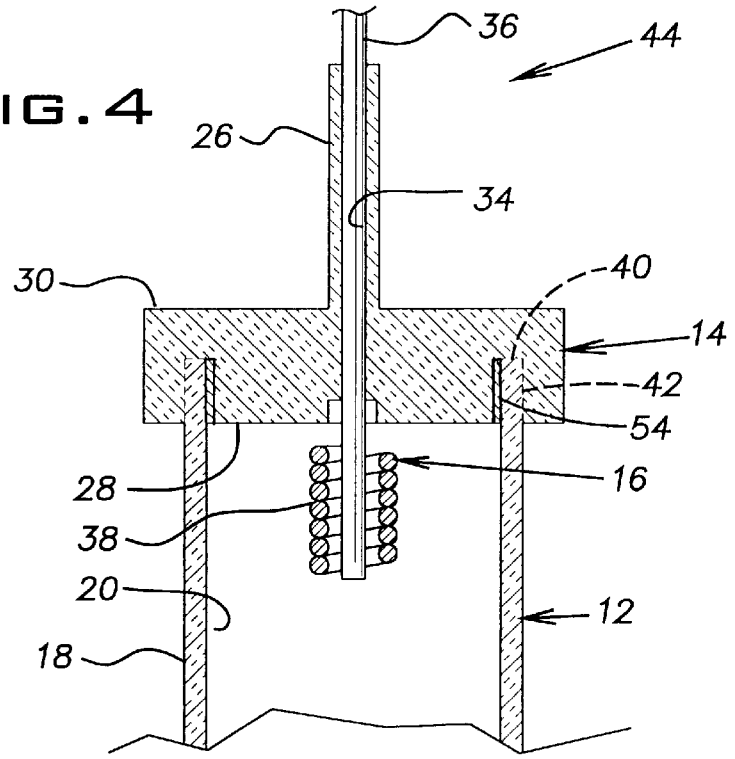
FIG. 4 is a side elevational view, in cross-section, similar to FIG. 3 but after firing to form a monolithic seal between the arc tube and the end cap.

As best shown in FIG. 4, a monolithic seal is created between the arc tube 12 and the end caps 14 upon sintering. The monolithic seal is not created at all of the interfaces. The monolithic seal is created at the first interface 40 between the arc tube end surfaces 17 and the groove bottom surfaces 28, and the second interface 42 between the arc tube outer surface 18 and the groove outer surfaces 50, but not between the arc tube inner surface 20 and the groove inner surface 52. Due to shrinkage of the "green" end caps 14 during the sintering step, an annularly shaped gap or space is created between the arc tube inner surface 20 and the groove inner surface 52 as the groove inner surface 52 pulls away from the arc tube inner surface 20.

Although a particular embodiment of the invention has been described in detail, it will be understood that the invention is not limited correspondingly in scope, but includes all changes and modifications coming within the spirit and terms of the claims appended hereto.

What is claimed is:

1. A method of making a tube assembly for a high-pressure discharge lamp, said method comprising the steps of:

providing a tube made of sapphire;

providing an end cap made of unsintered polycrystalline alumina;

heating said end cap until said end cap is presintered to remove binder;

placing said presintered end cap on an end portion of said tube to form an interface therebetween; and heating said presintered end cap and said tube until said end cap is sintered onto said tube and said sapphire tube grows into said end cap to form a monolithic seal at the interface between said end cap and said tube.

2. The method according to claim 1, wherein said step of heating said end cap and said tube includes shrinking an inner diameter of said end cap to a size smaller than an outer diameter of said tube.

3. The method according to claim 2, wherein said inner diameter of said end caps shrinks to a size of about 3% to about 7% smaller than said outer diameter of said tube.

4. The method according to claim 1, wherein said step of providing an end cap includes forming a disc-shaped main wall and a flange axially extending from an outer periphery of said main wall, and said step of heating said presintered end cap and said tube includes forming a monolithic seal at an interface between an inner surface of said end cap flange and an outer surface of said tube.

5. The method according to claim 4, wherein said step of placing said presintered end cap on an end portion of said tube includes engaging an end surface of said tube with an inner surface of said end cap main wall.

6. The method according to claim 5, wherein said step of heating said presintered end cap and said tube includes forming a monolithic seal at an interface between said inner surface of said end cap main wall and said end surface of said tube.

7. The method according to claim 1, wherein said step of providing an end cap includes forming a disc-shaped main wall and an annularly-shaped groove axially extending from a side of said main wall.

8. The method according to claim 7, wherein said step of heating said presintered end cap and said tube includes forming a monolithic seal at an interface between an outer groove surface of said end cap flange and an outer surface of said tube.

9. The method according to claim 8, wherein said step of placing said presintered end cap on an end portion of said tube includes engaging an end surface of said tube with a bottom surface of said end cap groove.

10. The method according to claim 9, wherein said step of heating said presintered end cap and said tube includes forming a monolithic seal at an interface between said bottom surface of said end cap groove and said end surface of said tube.

11. The method according to claim 8, wherein said step of heating said presintered end cap and said tube includes forming an annularly-shaped gap at an interface between an inner surface of said end cap groove and an inner surface of said tube.

12. The method according to claim 1, further comprising the step of continuing to heat said end cap and said tube after said end cap is fully sintered to said tube until initial stresses at said interface are removed.

13. The method according to claim 1, wherein said step of providing an end cap includes forming a disc-shaped main wall, a tubularly-shaped extension axially extending from a side of said main wall, and an aperture axially extending through said main wall and said extension.

14. The method according to claim 1, further comprising the step of doping said end cap with boundary enhancing material.

15. The method according to claim 14, further comprising the step of selecting said boundary enhancing material from the group of Gallium and Chromium.

16. The method according to claim 1, further comprising the step of painting at least one of said end cap and said tube at the interface with a boundary enhancing material.

17. The method according to claim 16, further comprising the step of selecting said boundary enhancing material from the group of Gallium and Chromium.

* * * * *

UNITED STATES PATENT AND TRADEMARK OFFICE

CERTIFICATE OF CORRECTION

PATENT NO. : 6,126,889

DATED : October 3, 2000

INVENTOR(S) : Curtis E. Scott et al.

It is certified that error appears in the above-indentified patent and that said Letters Patent is hereby corrected as shown below:

Col. 5, line 19 before "interface" insert --previous--.

Signed and Sealed this

Eighth Day of May, 2001

*Attest:*

Nicholas P. Godici

NICHOLAS P. GODICI

*Attesting Officer*

*Acting Director of the United States Patent and Trademark Office*